US006915097B2

(12) United States Patent
Okamoto

(10) Patent No.: US 6,915,097 B2
(45) Date of Patent: Jul. 5, 2005

(54) IMAGE FORMING APPARATUS AND CONTROL METHOD OF IMAGE FORMING APPARATUS

(75) Inventor: Masaya Okamoto, Saitama (JP)

(73) Assignee: Fuji Xerox Co., Ltd., Tokyo (JP)

( * ) Notice: Subject to any disclaimer, the term of this patent is extended or adjusted under 35 U.S.C. 154(b) by 0 days.

(21) Appl. No.: 10/650,991

(22) Filed: Aug. 29, 2003

(65) Prior Publication Data

US 2004/0156656 A1 Aug. 12, 2004

(30) Foreign Application Priority Data

Dec. 16, 2002 (JP) ..... P2002-364387

(51) Int. Cl.[7] ..... G03G 15/01; G03G 15/16

(52) U.S. Cl. ..... 399/302; 399/66; 399/101; 430/126

(58) Field of Search ..... 399/302, 43, 101, 399/66, 71, 308, 297; 430/125, 126

(56) References Cited

U.S. PATENT DOCUMENTS 5,926,670 A * 7/1999 Furuta et al. ..... 399/101
6,181,892 B1 * 1/2001 Fujimori ..... 399/302 X
6,253,039 B1 * 6/2001 Nakano et al. ..... 399/101 X
6,529,695 B2 * 3/2003 Katayanagi et al. .... 399/302 X
2001/0028817 A1 * 10/2001 Tamura et al. ..... 399/297
2002/0034406 A1 * 3/2002 Kawagoe et al. ..... 399/302
2003/0118379 A1 * 6/2003 Hattori ..... 399/297
2004/0114962 A1 * 6/2004 Okamoto et al. ..... 399/302 X

FOREIGN PATENT DOCUMENTS

JP 8-328348 12/1996
JP 2002-031965 A * 1/2002
JP 2002-082535 A * 3/2002
JP 2002-357961 A * 12/2002
JP 2003-122085 A * 4/2003

* cited by examiner

*Primary Examiner*—Sophia S. Chen
(74) *Attorney, Agent, or Firm*—Morgan, Lewis & Bockius LLP

(57) ABSTRACT

An image forming apparatus includes a photosensitive drum; an exposing unit to expose the photosensitive drum to form latent images to the respective colors of one print; a developing device to develop the latent images formed on the photosensitive drum; an intermediate transfer belt abutting against the photosensitive drum, to temporarily hold a toner image; a secondary transfer roller contacted/retracted with respect to the intermediate transfer belt to transfer the toner image to a document; an intermediate transfer member cleaner contacted/retracted to/from the intermediate transfer belt to remove residual toners left on the intermediate transfer belt, wherein the secondary transfer roller contacts the intermediate transfer belt before operations of the exposing unit are accomplished with all colors of toner images in one print, and is retracted from the intermediate transfer belt before a next print is commenced.

12 Claims, 5 Drawing Sheets

IMAGE FORMING APPARATUS AND CONTROL METHOD OF IMAGE FORMING APPARATUS

BACKGROUND OF THE INVENTION

1. Field of the Invention

The present invention relates to an image forming apparatus such as printers, copying machines, and facsimile machines. More specifically, the present invention is directed to an image forming apparatus equipped with an intermediate transfer member.

2. Description of the Related Art

In an image forming apparatus using an electrophotographic system such as printers, copying machines, and facsimile machines, image forming operations are carried out as follows: That is, after electrostatic latent images are acquired by electrostatic latent image forming unit in such a manner that light is irradiated onto image carriers such as photosensitive drums which have been uniformly charged, toners are applied to the charged electrostatic latent images by developing unit so as to produce visible images. Then, a plurality of toner images are transferred to intermediate transfer members in a multiple mode, and thereafter, these multiple toner images are transferred onto recording mediums so as to be fixed thereon.

As an example of conventional image forming apparatus, a rotary type developing unit disclosed in JP-A-8-328348 will be described hereinbelow. While a rotary type developing unit is provided in which four sets of color developing devices (yellow, magenta, cyan, black developing devices) functioning as developing unit are held in the vicinity of a photosensitive drum along a circumferential direction of a rotary member, toner images which are sequentially formed by the apparatus are transferred onto a transfer belt in an overlapping manner (refer to pages 3–4 and FIG. 1 of JP-A-8-328348).

In an image forming apparatus employing such an image forming system as disclosed in JP-A-8-328348, while a full-color image is outputted, a yellow toner image, a magenta toner image, a cyan toner image, and a black toner image are transferred (primary transferred) onto a transfer belt every time the transfer belt is rotated by one turn, so that these four color toner images are sequentially overlapped with each other on the transfer belt. From the portion where all of these four color toner images have be overlapped with each other, a toner image is transferred (secondary transferred) onto a recording at a secondary transfer position by employing, for example, a secondary transfer roller. At this time, if the secondary transfer roller is depressed to the transfer belt before all of these four color toner images are overlapped with each other, then intermediate toner images being overlapped are scratched up by the secondary transfer roller. To avoid the problem, the following method has been employed. That is, while the secondary transfer roller is separated (retracted) from the transfer belt until all of the four color toner images are overlapped with each other, the secondary transfer roller is push out (advanced) toward the transfer belt at required timing in order that the secondary transfer roller may be made in contact with the transfer belt.

In the image forming apparatus, after a secondary transfer operation of a toner image is accomplished at the secondary transfer position, residual toners are present on the transfer belt. These residual toners are such toners that could not be transferred to a recording medium and thus are left on the transfer belt. As a consequence, generally speaking, in the image forming apparatus, cleaners used for intermediate transfer members are installed around the transfer belts in order to remove the above-described residual toners (remaining toners). These cleaners for the intermediate transfer members are arranged under such a condition that these cleaners can be contacted/released (advanced/retracted) with respect to the transfer belts. For example, the cleaner used for an intermediate transfer member is configured as follows. That is, while the cleaner is retracted (separated) from a transfer belt in order not to scrape a toner image before being transferred (secondary transferred) until a toner image has been transferred (primary transferred) onto a transfer belt, the cleaner is caused to abut against the transfer belt at predetermined timing, so that toners left on the transfer belt after the secondary transfer operation has been accomplished may be scraped.

As explained above, in the conventional image forming apparatus, the image forming operations are carried out by employing such a construction that both the secondary transfer rollers and the cleaners for the intermediate transfer members are contacted/released (advanced/retracted) with respect to the transfer belts. The contacting/releasing operations of the secondary transfer rollers and the cleaners for the intermediate transfer members may cause shocks as well as vibrations with respect to image forming units. For example, while transfer rollers normally employ rollers made of rubber, these rubber transfer rollers are depressed against transfer belts under considerably large weights. As a result, the contacting/releasing operations of the transfer rollers may constitute load variations. For example, if shocks occurred when the transfer rollers abut against the transfer belts are transferred to the image forming units, then image disturbances may occur, which may cause color shifts. Also, load variations given to intermediate transfer belts may cause, for example, rotation fluctuations of photosensitive drums. Further, in such a case that both a photosensitive drum and a transfer belt are combined as an integral unit, load variations given to an intermediate transfer belt may vibrate the integral unit itself, which may sometimes cause color shifts during light exposing operation.

In this case, for example, as described in the above-explained patent publication JP-A-8-328348, when the distance between the primary transfer position and the secondary transfer position in the transfer belt can be made long, then the image forming apparatus may be designed by such a design concept that the secondary transfer roller may abut against the transfer belt after, for example, the last color toner image has been transferred onto the transfer belt, or after, for instance, the exposing operation used to form the final color toner image has been accomplished. However, in the case that a length of a transfer belt is made longer and a processing speed of an image forming process is increased, either the transfer belt or a photosensitive drum are necessarily required to be rotated in high speeds. To this end, high power is necessarily required, so that output power of a motor corresponding to a drive source is increased, and thus, power consumption is similarly increased. On the other hand, generally speaking, when lengths of transfer belts are made long, the image forming apparatus become bulky, so that the apparatus become unable to satisfy current requirements as to compactness/light weights of such image forming apparatus.

SUMMARY OF THE INVENTION

The present invention has been made to solve the above-explained technical problems of these conventional image forming apparatus, and therefore, has an object to provide such an image forming apparatus and a control method thereof, capable of suppressing disturbances of images which are caused by that a predetermined member is contacted/released (advanced/retracted) with respect to an intermediate transfer member.

Also, another object of the present invention is to provide such an image forming apparatus and a control method thereof, by which when the image forming apparatus employs such a structure that a secondary transfer member and the like are contacted/released (advanced/retracted) with respect to an intermediate transfer member, adverse influences made from shocks and heavy loads can be reduced which are caused by the contacting/releasing operations of the secondary transfer member during exposing operation.

In order to achieve the above objects, according to a first aspect of the invention, there is provided an image forming apparatus including: an image carrier; an exposing unit configured to expose the image carrier to form latent images of respective colors onto the image carrier; a developing unit configured to develop each of the latent images of the respective colors to form toner images of respective colors; an intermediate transfer member; and a secondary transferring unit configured to be contactable and retractable with and from the intermediate transfer member, wherein the image carrier transfers the toner images onto the intermediate transfer member in a multipled manner as a multiple toner image, wherein the secondary transferring unit transfers the multiple toner image on the intermediate transfer member onto a recording medium after being contact with the intermediate transfer member from a retracted state, and wherein an operating state of the secondary transferring unit transfers from the retracted state into a contacted state at such timing between an exposing operation by the exposing unit for a specific color and another exposing operation by the exposing unit for another color subsequent to the specific color within exposing operations thereof with respect to a single document.

According to a second aspect of the invention, there is provided an image forming apparatus including: an image carrier; an exposing unit configured to expose the image carrier to form latent images of respective colors onto the image carrier; a developing unit configured to develop each of the latent images of the respective colors to form toner images of respective colors; an intermediate transfer member; and an intermediate transfer member cleaning unit configured to remove residual toners remaining on the intermediate transfer member after the toner images being transferred onto the recording medium, and to be contactable and retractable with and from the intermediate transfer member, wherein the image carrier transfers the toner images onto the intermediate transfer member, wherein the intermediate transfer member transfers the toner images onto a recording medium, wherein the intermediate transfer member cleaning unit contacts with the intermediate transfer member at such timing that an exposing operation by the exposing unit is not carried out.

According to a third aspect of the invention, there is provided an image forming apparatus including: an image carrier; an exposing unit configured to expose the image carrier to form latent images of respective colors for a single document onto the image carrier; a developing unit configured to develop each of the latent images of the respective colors to form toner images of respective colors; an intermediate transfer member configured to be in contact with the image carrier; and a secondary transferring unit configured to be contactable and retractable with and from the intermediate transfer member, wherein the image carrier transfers the toner images onto the intermediate transfer member, wherein the secondary transferring unit transfers the toner images on the intermediate transfer member onto a recording medium, wherein the secondary transfer member contacts with the intermediate transfer member before completing exposing operations of the exposing unit with respect to all of color toner images for the single document, and wherein the secondary transfer member retracts from the intermediate transfer member before starting exposing operations of the exposing unit with respect to a next document to be printed after the single document.

According to a fourth aspect of the invention, there is provided an image forming apparatus including: an image carrier configured to be formed thereon a toner image; an intermediate transfer member made of an elastic belt supported in a flattening manner; a secondary transferring unit disposed at one end of the intermediate transfer member along a flattening longitudinal direction of the intermediate transfer member and configured to be contactable and retractable with and from the intermediate transfer member; and an intermediate transfer member cleaning unit disposed at the other end of the intermediate transfer member along the flattening longitudinal direction and removes residual toners remaining on the intermediate transfer member, wherein the image carrier transfers the toner image onto the intermediate transfer member, wherein the secondary transferring unit transfers the toner image on the intermediate transfer member onto a recording medium, and wherein the intermediate transfer member cleaning unit is configured to be contactable and retractable with and from the intermediate transfer member.

According to a fifth aspect of the invention, there is provided an image forming apparatus including: an image carrier configured to be formed thereon a toner image by being exposed at a predetermined exposing position; an intermediate transfer belt configured to temporarily hold thereon a toner images of a respective colors on a circumferential portion of the intermediate transfer belt; and a secondary transferring unit configured to be contactable and retractable with and from the intermediate transfer belt, wherein the image carrier transfers the toner image onto the intermediate transfer belt, wherein the secondary transferring unit transfers the toner image on the intermediate transfer member onto a recording medium, wherein a belt length of the intermediate transfer belt is determined by a sum of a maximum image length of a toner image held by the circumferential portion thereof, and an interimage length shorter than the maximum image length, and the secondary transferring unit contacts with the intermediate transfer belt over a process distance which is shorter than such a distance separated from the exposing position by the interimage length.

According to a sixth aspect of the invention, there is provided a control method for an image forming apparatus including: an image carrier; an exposing unit configured to expose the image carrier for respective colors of a specific document; an intermediate transfer member configured to be transferred thereon a toner images of the respective colors from the image carrier; a secondary transferring unit configured to transfer the toner images from the intermediate transfer member onto a recording medium, the control method including: contacting the secondary transferring unit with the intermediate transfer member at such timing between an exposing operation for a specific color and an exposing operation for another color subsequent to the specific color contained in the specific document; and retracting the secondary transferring unit from the intermediate transfer member at such timing after transferring the toner images onto the recording medium and before starting an exposing operation for a next document to be printed after the specific document.

BRIEF DESCRIPTION OF THE DRAWINGS

The above objects and advantages of the present invention will become more apparent by describing preferred exemplary embodiment thereof in detail with reference to the accompanying drawings, wherein.

DETAILED DESCRIPTION OF THE PREFERRED EMBODIMENTS

Referring now to the accompanying drawings, there is shown a preferred embodiment of the invention.

Figure 1:
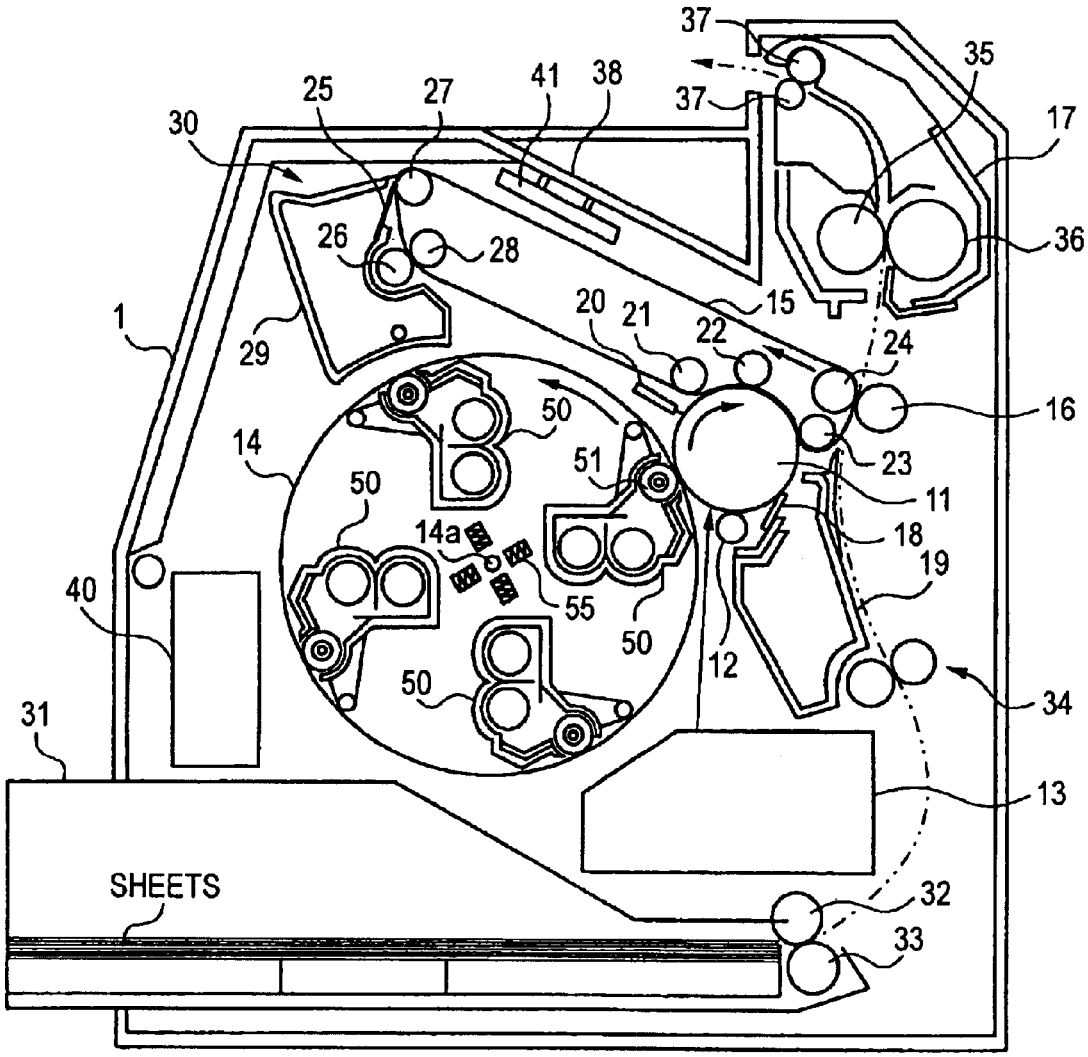
FIG. 1 is a diagram for indicating an entire arrangement of an image forming apparatus to which an embodiment of the present invention is applied.

FIG. 1 is a diagram indicating an entire structure of an image forming apparatus according to the preferred embodiment of the invention. The image forming apparatus shown in FIG. 1 is a digital color printer with employment of a rotary type developing unit. The image forming apparatus shown in FIG. 1 includes, within a main body 1 thereof, a photosensitive drum 11, a charging device 12, an exposing unit 13, and a developing unit 14. The photosensitive drum 11 is provided as an image carrier that forms an electrostatic latent image to carry thereon a toner image. The charging device 12 applies electron charges to the photosensitive drum 11 so as to charge the photosensitive drum 11 by employing a charge roller and the like. The exposing unit 13 is operated in such a manner that the charged photosensitive drum 11 is exposed at an exposing position by employing, for example, an ROS (Raster Output Scanner) in response to an image signal supplied from an image processing apparatus (IPS) which is not shown in the drawing. The developing unit 14 develops the electrostatic image formed on the photosensitive drum 11 by the exposing unit 13 so as to form a toner image.

The developing unit 14 corresponds to the rotary type developing unit, and is provided with four developing devices 50. The four developing devices 50 contain four color toners respectively in order to produce four color toner images, namely a yellow (Y)-color toner image, a magenta (M)-color toner image, a cyan (C)-color toner image, and a black (K)-color toner image. A developing roller 51 is provided on a circumference of the developing unit 14. The developing roller 51 corresponds to a developing agent carrier, which develops latent images formed on the photosensitive drum 11. Since the developing unit 14 is pivotally rotated at a rotation angle of 90 degrees while a developing unit center 14*a* is set as a center, the developing roller 51 equipped by the desirable developing device 50 may be located opposite to the photosensitive drum 11. In particular, with respect to one color print output, the respective color (Y, M, C, K) developing devices 50 are located opposite to the photosensitive drum 11 in the color order, so that a full-color print output may be produced. The developing devices 50 are arranged in such a manner that the developing devices 50 are depressed in a normal line direction by a plurality of coil springs 55 positioned on the developing unit center 14*a*, a tracking roller (will be explained later) used in positioning operation can surely abut against the photosensitive drum 11. The photosensitive drum 11 is pivotally rotated along an arrow direction (namely, clockwise direction) shown in the drawing, whereas the developing unit 14 is pivotally rotated along a counter-clockwise direction in order that the pivotal rotation (along clockwise direction) of the photosensitive drum 11 becomes equal to movement along the normal direction.

On a downstream side of the developing unit 14 over the photosensitive drum 11, there are provided with an intermediate transfer belt 15 corresponding to an intermediate transfer member, a secondary transfer roller 16 corresponding to a secondary transfer member, and a fixing apparatus 17. The intermediate transfer belt 15 temporarily holds thereon a toner image that has been developed by the developing device 50 to be formed on the photosensitive drum 11. The secondary transfer roller 16 transfers a toner image formed by superimposing a plurality of color toner images on the intermediate transfer belt 15, to a recording medium. The fixing apparatus 17 heats and depresses the toner image formed on the document so as to fix the toner image on the document. Furthermore, a cleaning blade 18 and a toner collecting bottle 19 are provided around the photosensitive drum 11. The cleaning blade 18 scrapes toners (residual toners) left on the photosensitive drum 11 after toner images have been transferred (primary transferred) onto the intermediate transfer belt 15. The toner collecting bottle 19 stores therein the toners scraped by the cleaning blade 18 in order to collect the scraped toners. A density sensor 20 is provided between the developing unit 14 and the intermediate transfer belt 15. The density sensor 20 corresponds to a reflection type sensor used to measure density (concentration) of toners supplied from the developing device 50. The intermediate transfer belt 15 is rotated 4 times while one print image is produced. The secondary transfer roller 16 is arranged as follows. That is, the secondary transfer roller 16 is retracted (separated) from the intermediate transfer belt 15 while the intermediate transfer belt 15 is rotated during first three rotations, namely, while the intermediate transfer belt 15 holds three color (Y, M, C) toner images. When a last color (K) toner image is superimposed on the color toner images, the secondary transfer roller 16 may be made in contact with the intermediate transfer belt 15.

The intermediate transfer belt 15 is contacted (abuts) in a wrap shape with respect to the photosensitive drum 11 in such a manner that the intermediate transfer belt 15 wraps the photosensitive drum 11 only over a predetermined range, and therefore, a so-called "wrap transfer" can be realized. The intermediate transfer belt 15 has a thickness of, for example, approximately 0.5 mm, and a circumferential length of 443 mm. As a material of the intermediate transfer belt 15, chloroprene having a superior characteristic in oil resisting and in anti-seasoning, EPDM having a superior characteristic in anti-seasoning, and the like are employed. In the embodiment, the intermediate transfer belt 15 is not provided with a drive source. The intermediate transfer belt 15 follows rotations of the photosensitive drum 11 by utilizing contacts made by the wrapping. The intermediate transfer belt 15 is pivotally rotated in the counter-clockwise direction in order that the rotation direction of the contact portion thereof is made coincident with that of the photosensitive drum 11.

A wrap-in roller 21, a primary transfer roller 22, and a wrap-out roller 23 are provided inside the intermediate transfer belt 15. The wrap-in roller 21 specifies a wrap position of the intermediate transfer belt 15 on the side of an upper stream in the rotation of the photosensitive drum 11. The primary transfer roller 22 transfers a toner image formed on the photosensitive drum 11 onto the intermediate transfer belt 15. The wrap-out roller 23 specifies a wrap position of the intermediate transfer belt 15 on the side of a down stream of the rotation of the photosensitive drum 11. A predetermined electric field is being applied to the primary transfer roller 22 in order to support the primary transfer operation. Both the wrap-in roller 21 and the wrap-out roller 23 are brought into either a GND (ground) potential state, or a floating state.

A back-up roller 24 for supporting a secondary transfer operation by the secondary transfer roller 16 is provided inside the intermediate transfer belt 15. In a secondary transferring unit in which the secondary transferring operation is carried out by both the secondary transfer roller 16 and the back-up roller 24, a predetermined potential difference is required between the back-up roller 24 and the secondary transfer roller 16. In such a case that one roller, for example, the secondary transfer roller 16 is connected to a high potential source, the other roller, namely, the back-up roller 24 is connected to the GND potential.

An intermediate transfer member cleaner 30 functioning as an intermediate transfer member cleaning unit is provided on the down-stream side of the secondary transferring unit on the intermediate transfer belt 15. The intermediate transfer member cleaner 30 removes toners left on the intermediate transfer belt 15 after the secondary transferring operation. The intermediate transfer member cleaner 30 is equipped with a scraper 25, a brush roller 26, and a second toner collecting bottle 29. The scraper 25 scrapes remaining toners after the secondary transferring operation. The brush roller 26 further scrapes such toners that have been left after the cleaning operation by the scraper 25 is accomplished. The second toner collecting bottle 29 collects the toners that have been scraped by both the scraper 25 and the brush roller 26. Further, a cleaning back-up roller 27 and another cleaning back-up roller 28 are provided inside the intermediate transfer belt 15. The cleaning back-up roller 27 assists the cleaning operation by the scraper 25, whereas the cleaning back-up roller 28 assists the cleaning operation of the brush roller 26.

The scraper 25 is made of a thin metal plate having a thickness of approximately 0.1 mm, for example, a stainless steel, to which a predetermined electric field is being applied. The brush roller 26 corresponds to a nylon (polyamide) brush, or an acrylic brush, which have been processed as to conductivity thereof. The brush roller 26 is rotated by receiving power supplied from a drive source, and then, scraped toners are stored from a window formed in the second toner collecting bottle 29 into the internal area of the second toner collecting bottle 29. Both the scraper 25 and the brush roller 26 scrape toners left on the intermediate transfer belt 15 after the secondary transfer roller 16 has performed the secondary transferring operation by being made in contact to the intermediate transfer belt 15. To secure the scraping operation, both the scraper 25 and the brush roller 26 are arranged in such a manner that in the first stage of the image forming operation, both the scraper 25 and the brush roller 26 are retracted from the intermediate transfer belt 15 in order that toner images under superimposing operation are not scraped, and the scraper 25 and the brush roller 26 are contacted to the intermediate transfer belt 15 in an integral form.

As indicated in FIG. 1, in the embodiment, while such a layout is employed, namely, the intermediate transfer belt 15 is made relatively long, the intermediate transfer belt 15 is flattening-supported by the wrap-in roller 21, the wrap-out roller 23, the back-up roller 24, the cleaning back-up roller 27, and the cleaning back-up roller 28. A secondary transferring unit to which the secondary transfer roller 16 abuts is provided at one end of the flattening-supported intermediate transfer belt 15 along a longitudinal direction, whereas the intermediate transfer member cleaner 30 is arranged at the other end thereof along the longitudinal direction. The secondary transferring unit to which the secondary transfer roller 16 abuts is provided in the vicinity of such a position that the intermediate transfer belt 15 abuts with respect to the photosensitive drum 11 in a wrap shape. In other words, the photosensitive drum 11 is arranged at a position near the secondary transferring unit to which the secondary transfer roller abuts 16, which is nearer than another position where the intermediate transfer member cleaner 30 is provided. As previously explained, in accordance with the embodiment, in such an image forming apparatus using the intermediate transfer belt 15 which is pivotally rotated every color, such a structural layout is employed. That is, the secondary transferring unit is provided just after (relatively close to) the primary transferring unit to which both the photosensitive drum 11 and the intermediate transfer belt 15 abut in the wrap shape.

As a document transporting system, the image forming apparatus is equipped with a document supply cassette 31, a feed roller 32, a retard roller 33, a register roller 34, a heat roller 35, a pressure roller 36, an eject roller 37, and an eject tray 38. The document supply cassette 31 stores therein various sorts of recording media, for example, recording mediums and OHP (overhead projector) sheets. The feed roller 32 feeds out documents from the document supply cassette 31 to supply these fed documents. The retard roller 33 sorts supplied documents every 1 sheet. The register roller 34 adjusts (registers) transfer timing with respect to a document transported for the document supply cassette 31 via the feed roller 32 and the like. The heat roller 35 is provided within the fixing apparatus 17, and heats a toner image formed on a document. The pressure roller 36 is provided opposite to the heat roller 35, and depresses a document when being heated by the heat roller 35. The eject roller 37 ejects a copy document out of the image forming apparatus after fixing operation. The eject tray 38 stores therein a document ejected from the eject roller 37. As indicated in FIG. 1, in the image forming apparatus to which the embodiment is applied, a secondary transfer operation can be carried out in a document transport path along the longitudinal direction. Also, since the document transfer path is made very short, a total quantity of structural components employed in the image forming apparatus can be reduced, so that cost-down aspect thereof can be realized. Furthermore, reliability with respect to document transporting operations can be improved.

The image forming apparatus of the embodiment is provided with a control unit 40 and a position sensor 41. The control unit 40 controls operations of the respective members employed in the image forming apparatus. The position sensor 41 corresponds to a reflection type photosensor, and is provided adjacent to the intermediate transfer belt 15. The position sensor 41 senses a patch of a toner, which is formed on the intermediate transfer belt 15. Since the position sensor 41 reads out the patch formed on the intermediate transfer belt 15 along the longitudinal direction, the position sensor 41 can detect a position of the intermediate transfer belt 15 along a rotation direction. In particular, since an exposing operation is carried out at pre-selected timing after such a position that the patch has been detected by the position sensor 41, positioning (registering) operations of the respective colors Y, M, C, K can be carried out. Also, while density of a toner formed on the intermediate transfer belt 15 is sensed based upon a sensor output of the position sensor 41, a density control operation is carried out by the control unit 40 based on the density sensing result.

Next, a description will now be made of an image forming process operation with employment of the image forming apparatus shown in FIG. 1. In the image forming apparatus, upon receipt of an output request issued from either a PC (personal computer) or an image reading apparatus, which are externally connected to the image forming apparatus, an image forming process is commenced based upon an instruction sent from the control unit 40. In the case that a full-color print is outputted, in the developing unit 14, the yellow (Y)-color developing device 50 is pivotally rotated so as to be located opposite to the photosensitive drum 11. When a yellow (Y)-color toner image is firstly formed, the photosensitive drum 11 pivotally rotated along the clockwise direction is charged by the charging device 12 in the charging unit corresponding to the electron charge forming process. Thereafter, an exposing operation is carried out at the exposing position based upon image information corresponding to the yellow color by way of, for example, laser light emitted from the exposing unit 13, so that an electrostatic latent image is formed. Thereafter, after the developing operation is carried out by the developing roller 51, an yellow (Y)-color toner image is transferred onto the intermediate transfer belt 15 in the wrap-shaped contact range (wrap range). At this time, while the secondary transfer roller 16, the scraper 25, and the brush roller 26 are retracted (separated) from the intermediate transfer belt 15, the yellow-color toner image transferred onto the intermediate transfer belt 15 is not scraped by the structural members.

On the surface of the photosensitive drum 11 after the primary transfer operation has been accomplished, the toners left on the surface is scraped by the cleaning blade 18, and then, the cleaned surface of the photosensitive drum 11 is moved to the charging unit by the charging device 12 in order to form the next toner image. Then, the developing unit 14 is pivotally rotated so as to be fitted to the developing timing, so that the magenta (M)-color developing device 50 is located opposite to the photosensitive drum 11. A magenta (M)-color toner image is formed from a latent image to which the exposing operation has been carried out by the exposing unit 13 based upon magenta image information, and then, the magenta toner image is superimposed onto the intermediate transfer belt 15. Similarly, a cyan (C)-color toner image, and a black (K)-color toner image are sequentially superimposed on the intermediate transfer belt 15, so that the primary transferring operation is accomplished.

The secondary transfer roller 16 is advanced (push out) with respect to the intermediate transfer belt 15 after the primary transfer operation with respect to the cyan-color toner image exposed by the exposing unit 13 has been accomplished and before an exposing operation (exposing operation of black image) used to form a black latent image by the exposing unit 13 is commenced at an interimage produced after the toner image on which the three colors until the cyan color have been superimposed has passed through a secondary transferring unit (namely, place where secondary transferring operation is carried out by secondary transfer roller 16). Then, the image forming apparatus is prepared for a secondary transferring operation under such a condition that the secondary transfer roller 16 abuts (contacts) against the intermediate transfer belt 15. Also, both the scraper 25 and the brush roller 26 are advanced with respect to the intermediate transfer belt 15 after the exposing operation of the black latent image has been accomplished when the cleaner unit (namely, place where cleaning operation is carried out by scraper 25 and brush roller 26) is an interimage. The interimage corresponds to such an area portion on either the intermediate transfer belt 15 or the photosensitive drum 11, in which a toner image is not formed (namely, area portion where formation of toner image is not scheduled), or corresponds to such a portion where a writing operation by an exposing operation is not scheduled. A detailed content as to the interimage will be described later.

Recording mediums are successively derived from the document supply cassette 31 by driving the feed roller 32 at pre-selected timing under control of the control unit 40, and the derived documents are sorted every one sheet by the retard roller 33, and then, the sorted document is reached to the register roller 34. The register roller 34 owns such a function that the register roller 34 is rotated at the timing of the secondary transferring operation in the secondary transferring unit so as to feed out the recording medium at predetermined timing to the secondary transferring unit. In the embodiment, since the surface of the toner collecting bottle 19 is employed as the document transport path, the document is transported by utilizing the document transport path.

The document to which the toner image has been transferred in the secondary transferring unit is transported to the fixing apparatus 17. In the fixing apparatus 17, the toner image transferred onto the document is heated by the heat roller 35, and depressed to the document by the pressure roller 36, and thus, is fixed. Thereafter, the document on which the toner image has been fixed is outputted via the eject roller 37 outside the image forming apparatus, and then, is stored in the eject tray 38 provided on an upper unit of a main body 1 of the image forming apparatus. As previously explained, the image forming process executed when one sheet of color print is outputted is accomplished. As previously described, in the embodiment, while the size of the main body 1 can be made very small, the secondary transferring unit is made of the flattering layout and relatively narrow, so that the secondary transfer operation can be carried out in the longitudinal transport path.

Next, the photosensitive drum 11, the developing unit 14, and the intermediate transfer belt 15 will now be explained in detail.

Figure 2:
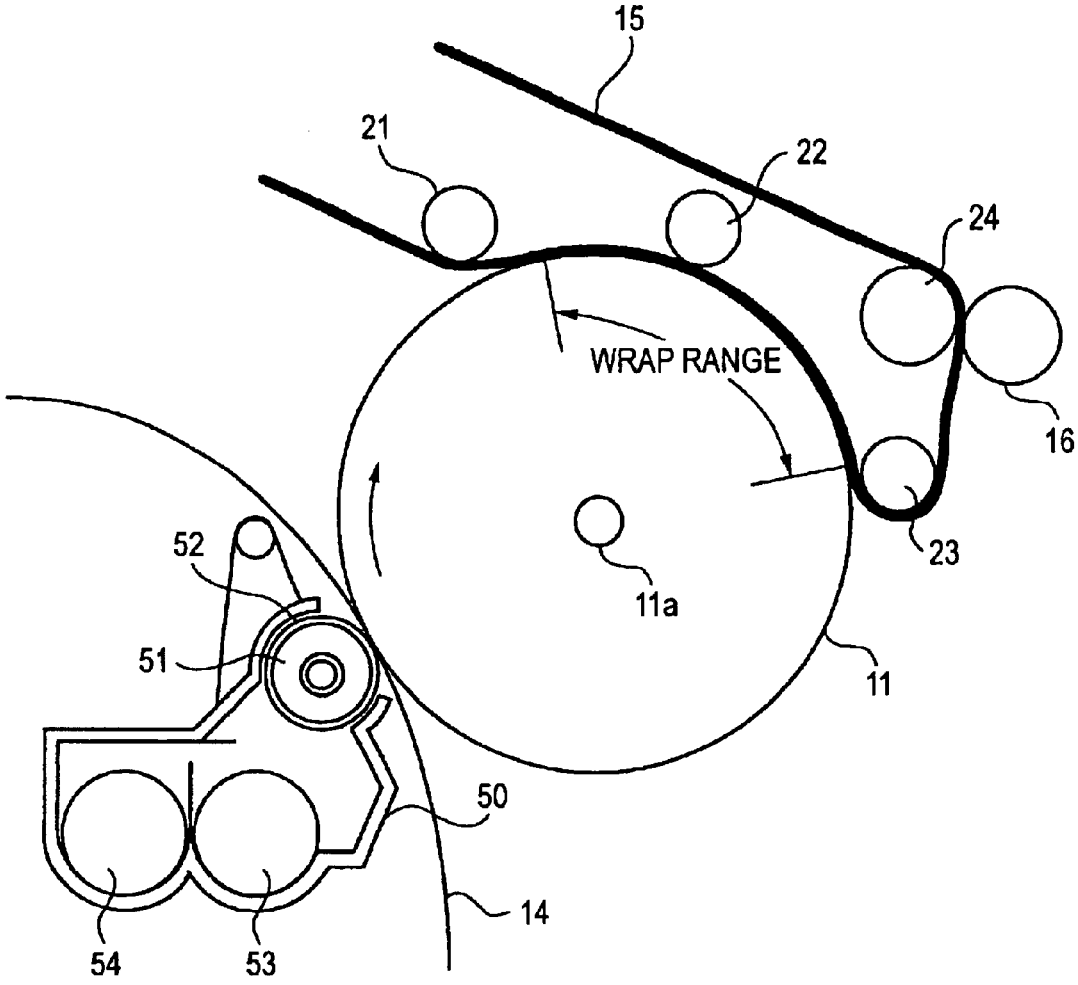
FIG. 2 is an explanatory diagram for explaining a relationship among a photosensitive drum, a developing unit, and an intermediate transfer belt.

FIG. 2 is an explanatory diagram for explaining a relationship among the photosensitive drum 11, the developing unit 14, and the intermediate transfer belt 15. The photosensitive drum 11 is made of a tube-shaped member having a diameter of approximately 47 mm, and a photosensitive layer is formed on a surface of an aluminum pipe. The photosensitive drum 11 receives drive force of a motor (not shown) from a shaft 11*a* of a center unit thereof via flanges (not shown) made of aluminum, which are provided on both edges of the aluminum pipe. For instance, in such a case that a color image having a length (297 mm) of an A4-document size along the longitudinal direction is printed out at a speed of 5 sheets (5 ppm) per 1 minute, 20 sheets of images (namely, 4 color images×5 sheets) must be formed within 1 minute on the photosensitive drum 11. The photosensitive drum 11 is arranged in such a manner that the photosensitive drum 11 is rotated 3 turns in order to form one image. In other words, the photosensitive drum 11 is rotated at a speed of approximately 150 mm/sec, 1 turn per 1 second. Also, in order to reduce color shifts caused by eccentricity and the like of the photosensitive drum 11, the respective color images are desirably formed at the same place on the photosensitive drum 11.

Each of four color (Y, M, C, K) developing devices 50 which constitute the developing unit 14 is equipped with a developing roller 51, a tracking roller 52, a supply auger 53, and an admix auger 54. The developing roller 51 corresponds to a developing agent carrier that carries a developing agent. The tracking roller 52 corresponds to a positioning member that is used to keep a distance between the developing roller 51 and the photosensitive drum 11 at a constant value. Both the supply anger 53 and the admix anger 54 may stir the developing agent supplied to the developing roller 51. The developing roller 51 is made of a tube-shaped member having a diameter of approximately 16 mm. While carriers contained in the developing agent are absorbed by using magnetic force by way of a magnet roller (not shown) arranged inside the developing roller 51, a magnetic brush of the developing agent is formed on the surface of the developing roller 51, so that the toners absorbed on the carriers may be transported to the developing area of the photosensitive drum 11. Since the magnetic brush formed in above-descrived manner performs the developing operation while the brush tip portions are contacted to the surface of the photosensitive drum 11, the distance between the photosensitive drum 11 and the developing roller 51 is always required to keep a certain constant interval.

To this end, the tracking roller 52 whose radius is slightly larger than the radius of the developing roller 51 by approximately 0.3 mm is provided with the developing roller 51 in a coaxial manner at both end units (In-side and Out-side of apparatus, or right side and left side of apparatus) of the developing roller 51. For example, assuming now that the diameter of the developing roller 51 is equal to 16 mm, the diameter of the tracking roller 52 becomes 16.6 mm. As the tracking roller 52, such a tracking roller made of synthetic resin such as polyacetal is employed. The tracking roller 52 is provided with each of the four developing devices 50 arranged in the developing unit 14. In the developing unit 14, when the developing devices 50 are switched, the desirable developing roller 51 is pivotally rotated at the rotating speed of 90 degrees per 0.7 seconds so as to be located opposite to the photosensitive drum 11. At this time, the tracking roller 52 may abut against the photosensitive drum 11 by being traced over the circumferential unit. Also, the tracking roller 52 is made in contact with the photosensitive drum 11, while shocks may be reduced by receiving predetermined elastic force produced by the coil spring 55 shown in FIG. 1.

On the other hand, the intermediate transfer belt 15 is made in contact to the photosensitive drum 11 with respect to a wrap range shown in FIG. 2 in such a manner that the photosensitive drum 11 is covered by the intermediate transfer belt 15 in combination with both the wrap-in roller 21 and the wrap-out roller 23. Both the wrap-in roller 21 and the wrap-out roller 23 are not made in contact with the photosensitive drum 11, but can prevent sandwiching of the intermediate transfer belt 15 due to fluctuations and the like as to the photosensitive drum 11, and may suppress damages given to the intermediate transfer belt 15. The wrap range (namely, wrap-shaped contact range) as indicated in FIG. 2 corresponds to such an arc range formed by an angle of about 90 degrees at a circumferential portion of the photosensitive drum 11. The intermediate transfer belt 15 is an elastic belt, and depresses the photosensitive drum 11 in a relatively strong weight. More specifically, in the embodiment, while no drive force is applied to the intermediate transfer belt 15 itself, since the intermediate transfer belt 15 may be followed by receiving the drive force of the photosensitive drum 11, the contact pressure becomes relatively high.

Figure 3:
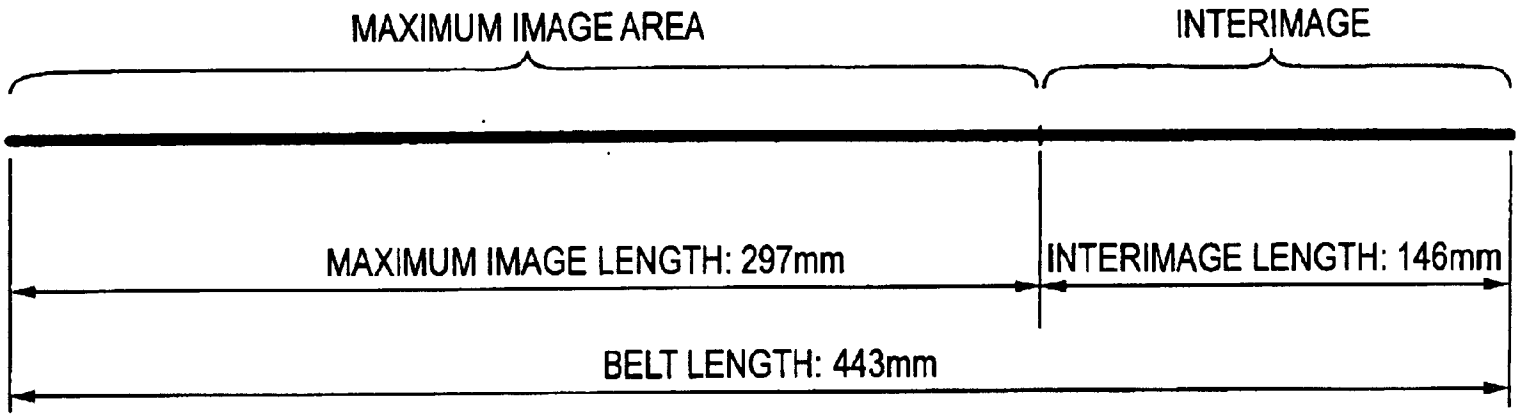
FIG. 3 is an explanatory diagram for explaining an image area and an interimage.

FIG. 3 is a diagram for explaining both an image area and an interimage. In FIG. 3, one circle of the intermediate transfer belt 15 is indicated by a wide straight line. Both the image area and the interimage are present in the intermediate transfer belt 15 corresponding to the intermediate transfer member. The image area corresponds to such an area that toner images are sequentially superimposed thereon so as to form a full-color toner image. The interimage corresponds to an area where no toner image is formed. In FIG. 3, there is shown such a relationship between a maximum image area and an interimage, which constitute a basis of designing aspects. In the embodiment, for example, as to the entire belt length (namely, 443 mm) of the intermediate transfer belt 15, such a length of 297 mm corresponding to the longitudinal document feeding size of the A4-sized document is defined as a maximum image length. At this time, a length of an interimage is configured to be 146 mm (=443 mm −297 mm). In other words, the entire belt length of the intermediate transfer belt 15 is defined by both the maximum image length and the interimage length which is shorter than the maximum image length. The maximum image length owns such a possibility that a toner image may be held on a peripheral unit thereof.

Both the above-described advancing (contacting) operations and the above-explained retracting (separating) operations of the secondary transfer roller 16 and the intermediate transfer member cleaner 30 are executed at such timing when the interimage defined on the intermediate transfer belt 15 is reached to both the secondary transferring position and the cleaner position. The interimage may be made different form each other depending upon a layout of an image forming apparatus. As a consequence, both timing of advancing operations and timing of retracting operations as to the secondary transfer roller 16 and the intermediate transfer member cleaner 30 is configured based upon the diameter of the photosensitive drum 11, the length of the intermediate transfer belt 15, setting positions of these members, and the maximum print size producible in the image forming apparatus.

Figure 4:
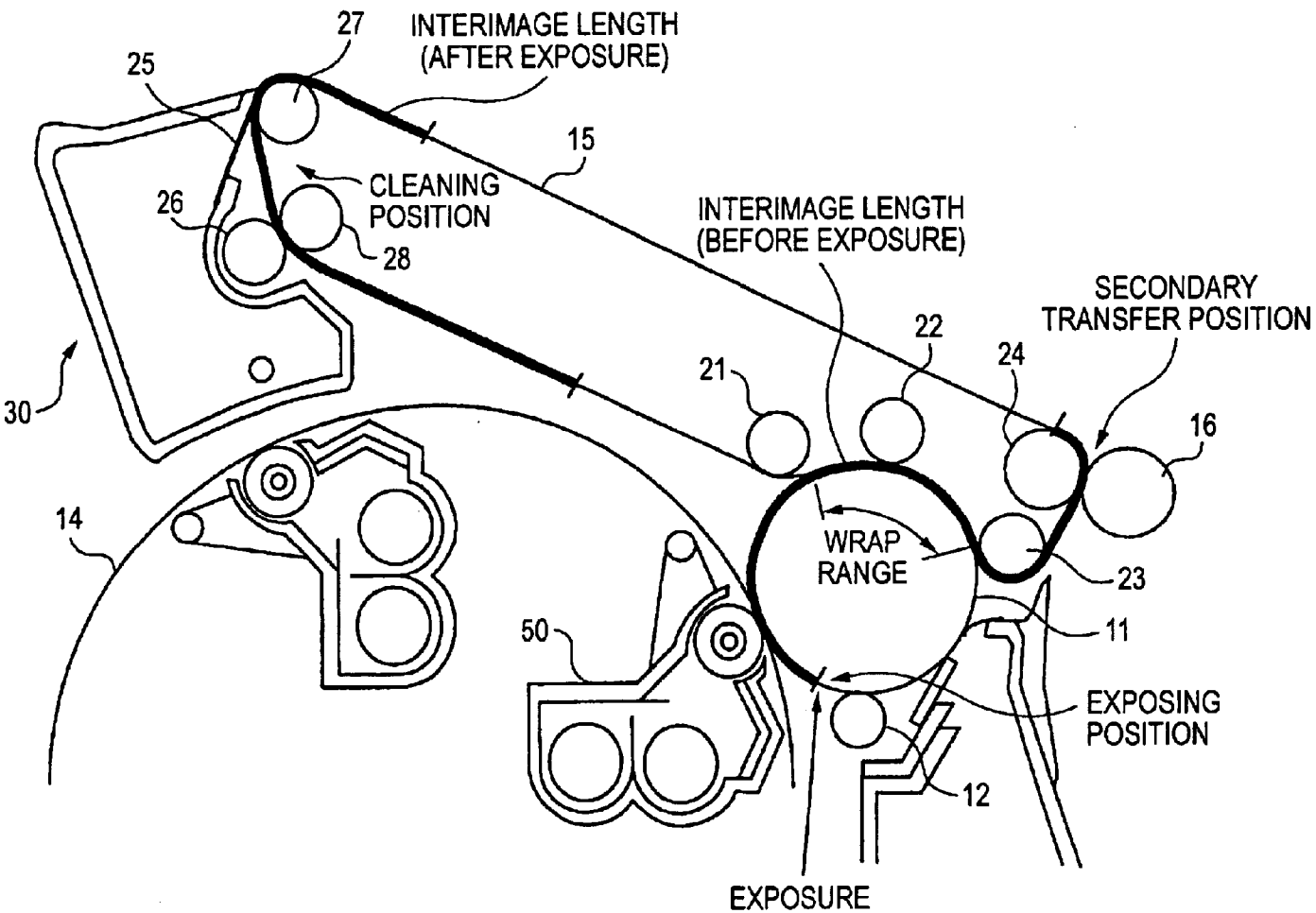
FIG. 4 is an explanatory diagram for explaining timing between the interimage and an image formation.

FIG. 4 is a schematic diagram for illustratively showing both an interimage position before exposure timing and an arrangement of functional components used to form an image, and also another interimage position after exposure timing and another arrangement of functional components used to form an image in a combination manner. An exposing operation (namely, image writing operation) is carried out by the exposing unit 13 at an exposing position, which corresponds to an exposing point on the photosensitive drum 11. In FIG. 4, interimages before/after the exposure timing are indicated by two wide lines. Also, in FIG. 4, the exposing position, a wrap range defined by the photosensitive drum 11 and the intermediate transfer belt 15, the secondary transferring position, and the cleaner unit are illustrated. As indicated in FIG. 4, the interimage before the image writing operation is elongated from the exposing position through the circumferential portion of the photosensitive drum 11 and the wrap range up to such a position exceeding the secondary transferring unit over the intermediate transfer belt 15, namely elongated from the exposing position by 146 mm. In other words, in the embodiment, the secondary transfer roller 16 is arranged in such a manner that the secondary transfer roller 16 abuts against the intermediate transfer belt 15 within the interimage before the image writing operation by the exposing unit 13 is performed, namely, over such a process distance shorter than the distance separated form the exposing position only by the length of the interimage.

As illustrated in FIG. 4, the interimage after an image has been written is elongated by 146 mm from such a starting point separated by 294 mm corresponding to a maximum image length from the exposing position along a downstream side. In the embodiment, the image forming apparatus is so arranged that the intermediate transfer member cleaner 30 is advanced toward the intermediate transfer belt 15 and then abuts (contacts) against the transfer belt 15 in the interimage. To this end, the intermediate transfer member cleaner 30 is arranged by such a layout that the intermediate transfer member cleaner 30 is entered into the interimage after the image writing operation has been carried out.

In the case above, the secondary transfer roller 16 depresses the intermediate transfer belt 15 in a weight of 4 kg to 5 kg in the secondary transferring position. The intermediate transfer belt 15 strongly abuts against the photosensitive drum 11 in the wrap range corresponding to the primary transferring position. As a result, the secondary transfer roller 16 gives a very large influence to the photosensitive drum 11 while the secondary transfer roller 16 is advanced to, and retracted from the photosensitive drum 11. More specifically, when the secondary transfer roller 16 is contacted to, or separated from the intermediate transfer belt 15 while the exposing operation (image writing operation) is carried out by the exposing unit 13, shocks and vibrations, which are caused by these contacting/retracting operations of the secondary transfer roller 16, are transmitted via the intermediate transfer belt 15 to the photosensitive drum 11, so that the shocks and vibrations occurred at the exposing position may cause disturbances of images. Similarly, when both the scraper 25 and the brush roller 26 provided in the intermediate transfer member cleaner 30 are contacted to, and retracted from the intermediate transfer belt 15, shocks and vibrations, which are caused by these contacting/retracting operations of the scraper 25, and the brush roller 26, are transmitted to the photosensitive drum 11 which is contacted to the intermediate transfer belt 15 in the wrap shape. As a result, there is such a risk that these vibrations and shocks may cause disturbances in the exposing operation (image writing operation), resulting in adverse influences given to images.

As a consequence, in the image forming apparatus according to the embodiment, such a specific arrangement is made. That is, both the secondary transfer roller 16 and the intermediate transfer member cleaner 30 are advanced and retracted with respect to the intermediate transfer belt 15 on the interimage while the exposing unit 13 does not perform the image writing operation with respect to the exposing position of the photosensitive drum 11. The vibrations and shocks, which are produced by that a predetermined member, is advanced/retracted to/from the intermediate transfer belt 15 may similarly give adverse influences to the primary transferring operation. However, in the embodiment, since the image forming apparatus employs a so-called "wrap transfer operation" in which the intermediate transfer belt 15 abuts against the photosensitive drum 11 in the wrap form, the above-described image disturbances occurred in the primary transferring operation may be suppressed to a minimum adverse influence.

Figure 5:
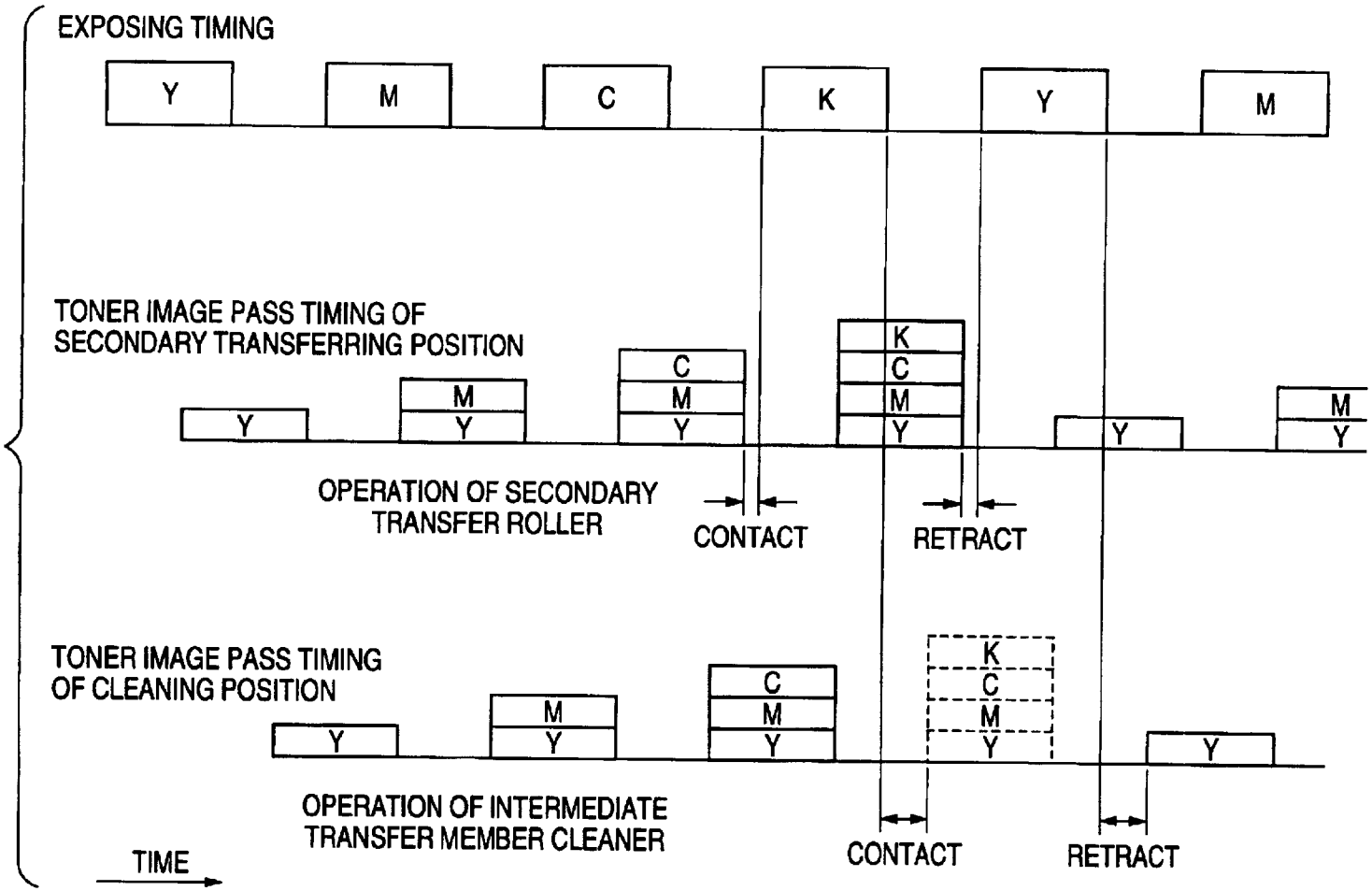
FIG. 5 is a diagram for indicating timing relationship between exposing timing, and operations of both a secondary transfer roller and an intermediate transfer member cleaner.

FIG. 5 is a diagram for showing timing relationship between exposing timing and operations of both the secondary transfer roller 16 and the intermediate transfer member cleaner 30. The operations are controlled by the control unit 40. In the drawing, the relationship among the operations is illustrated from the left direction to the right direction along the time elapse. In the exposing timing shown in an upper stage of the drawing, in the exposing unit 13, exposing operations for a first one print are carried out in this order of such image forming operations as to a Y (yellow) image, an M (magenta) image, a C (cyan) image, and a K (black) image. Thereafter, as to a next one print, a Y-exposing operation, an M-exposing operation, a C-exposing operation and a K-exposing operation are sequentially carried out. First, a Y-color toner image is once held on the intermediate transfer belt 15, and then, an M-color toner image is superimposed on the Y-color toner image in the next period. In the secondary transferring position in which the secondary transferring operation by the secondary transfer roller 16 is carried out, the toner image held on the intermediate transfer belt 15 passes through the secondary transferring unit at such timing as shown in a middle stage of the drawing. In the cleaner unit to which the intermediate transfer member cleaner 30 is advanced, the toner image held on the intermediate transfer belt 15 passes through the cleaner unit at such timing as represented in a lower stage of the drawing.

At such timing between the cyan (C)-color exposing operation and the black (k)-color exposing operation before all of the four colors (Y, M, C, K) exposing operations corresponding to 1 print are accomplished, and further, after the toner image has passed through the secondary transferring position, the secondary transfer roller 16 is push out (advanced) toward the intermediate transfer belt 15 and then abuts (contacts) against the intermediate transfer belt 15. In other words, before a final-color (for example, black (k)) latent image is exposed during 1 print (namely, after second last-color (e.g., cyan (c)) latent image has been exposed), the secondary transfer roller 16 is advanced to the intermediate transfer belt 15 at such timing when such a toner image passes through the secondary transferring unit. The toner image is, for instance, such a toner image produced by superimposing thereon Y, M, C-color toner images until a color (e.g., cyan) toner image preceding to the final color (e.g., black) toner image has been superimposed on the toner image. After all of the four colors (Y, M, C, K) exposing operations for one print have been accomplished, before a yellow (Y)-color exposing operation corresponding to a first color (head color) of a next print is commenced, and furthermore, after the toner image to which all of the color toner images have been superimposed has passed through the secondary transferring unit (namely, after secondary transferring operation has been accomplished with respect to document), the secondary transfer roller 16 is retracted (separated) from the intermediate transfer belt 15.

Since the advancing/retracting operations of the secondary transfer roller 16 are controlled by the control unit 40, even in such a case that such a layout is employed in which the primary transferring position is located close to the secondary transferring position, and also, the image size of the maximum length is formed along the document transporting direction, the advancing/retracting operations of the secondary transfer roller 16 is not carried out during the exposing operation. As a result, the shocks and the vibrations caused by the secondary transfer roller 16 are not transferred to the exposing position while the exposing operation is carried out. Alternatively, in such a case that the next print is not present after all of the four colors (Y, M, C, K) exposing operations have been accomplished for one print, while the secondary transfer roller 16 is not immediately retracted from the intermediate transfer belt 15, the secondary transfer roller 16 may be continuously contacted to the intermediate transfer belt 15, and thus, unnecessary toners attached to the surface of the secondary transfer roller 16 may be cleaned by applying both a positive bias voltage and a negative bias voltage to the secondary transfer roller 16.

After the exposing operation of the last color (namely, black) among the four colors (Y, M, C, k) corresponding to 1 print has been accomplished, and before the residual toners are transported to the cleaner unit (namely, before residual toners after secondary transfer operation is reached to cleaner unit), the intermediate transfer member cleaner 30 is push out (advanced) to abut (be contacted) against the intermediate transfer belt 15. Thereafter, even when all of the residual toners have been scraped, the intermediate transfer member cleaner 30 is not immediately retracted. Then, at such timing after the exposing operation of the Y (yellow)-color corresponding to the first color of the next print has been ended, and furthermore, before the exposed yellow (Y)-color toner image is reached to the cleaner unit, the intermediate transfer member cleaner 30 is separated (retracted) from the intermediate transfer belt 15. Since the retracting operation of the intermediate transfer number cleaner 30 is controlled by the control unit 40 in such a way that the intermediate transfer member cleaner 30 is retracted at the above-described timing, the advancing/retracting operations of the intermediate transfer member cleaner 30 are not carried out during the exposing operation, and thus, it is possible to avoid such a problem that the shocks/vibrations produced from the intermediate transfer member cleaner 30 are transferred to the exposing position during the exposing operation. Alternatively, in such a case that the next print is not present after all of the four colors (Y, M, C, K) exposing operations have been accomplished for one print, the intermediate transfer member cleaner 30 may not be immediately retracted from the intermediate transfer belt 15. As a result, the time duration during which the intermediate transfer member cleaner 30 abuts (be contacted) against the intermediate transfer belt 15 can be shortened after the printing operation is accomplished, so that there is such a merit that the lifetime of the intermediate transfer belt 15 may be extended.

As previously explained, in the embodiment, such a member as the secondary transfer roller 16 which is depressed with respect to the intermediate transfer belt 15 at a predetermined weight is arranged in the secondary transferring position, and the member is advanced/retracted with respect to the intermediate transfer belt 15. Also, while the intermediate transfer belt 15 abuts against the photosensitive drum 11 in the wrap shape. The secondary transferring position is arranged in the vicinity of the wrap range. In accordance with the embodiment, before the exposing (image writing) operations for all of the color images are accomplished, the secondary transfer operations are carried out in such a layout. At this time, since the above-explained control method is employed, the disturbances of the images caused by the vibrations, the shocks, and the load variations can be reduced, which are produced by that the secondary transfer roller 16 abuts against the secondary transfer belt 15. Furthermore, since the above-explained control method is also employed with respect to the intermediate transfer member cleaner 30 which abuts against the intermediate transfer belt 15, the disturbances of the images caused by the vibrations and the shocks can be suppressed in a similar manner.

It should be understood that the embodiment has explained that the photosensitive drum 11 has been exemplified as the image carrier. Similarly, the present invention may be applied to such a case that a belt-shaped member may be employed as the image carrier. Also, as the developing unit 14, the rotary type developing unit has been exemplified. Alternatively, the present invention may be applied to such a developing unit other than the rotary type developing unit.

As previously described, in accordance with the present invention, the disturbances of the images caused by that the predetermined member is contacted/retracted to/from the intermediate transfer member can be suppressed.

Although the present invention has been shown and described with reference to a specific preferred embodiment, various changes and modifications will be apparent to those skilled in the art from the teachings herein. Such changes and modifications as are obvious are deemed to come within the spirit, scope and contemplation of the invention as defined in the appended claims.

What is claimed is:

1. An image forming apparatus comprising: an image carrier; an exposing unit configured to expose the image carrier to form latent images of respective colors onto the image carrier; a developing unit configured to develop each of the latent images of the respective colors to form toner images of respective colors; an intermediate transfer member; and a secondary transferring unit configured to be contactable and retractable with and from the intermediate transfer member, wherein the image carrier transfers the toner images onto the intermediate transfer member in a multipled manner as a multiple toner image, wherein the secondary transferring unit transfers the multiple toner image on the intermediate transfer member onto a recording medium after being contact with the intermediate transfer member from a retracted state, and wherein an operating state of the secondary transferring unit transfers from the retracted state into a contacted state at such timing between an exposing operation by the exposing unit for a specific color and another exposing operation by the exposing unit for another color subsequent to the specific color within exposing operations thereof with respect to a single document.

2. The image forming apparatus as claimed in claim 1, wherein the secondary transferring unit contacts with the intermediate transfer member at such timing after the multiple toner image held by the intermediate transfer member has passed through a contact position where the secondary transferring unit contacts to the intermediate transfer member.

3. The image forming apparatus as claimed in claim 1, wherein the specific color corresponds to a color preceding to a last color during the exposing operations of the single document.

4. The image forming apparatus as claimed in claim 1, wherein in a case where a next document is to be printed after the single document, the secondary transferring unit retracts from the intermediate transfer member after a transfer operation of the single document has been accomplished and before an exposing operation by the exposing unit with respect to a head color contained in the next document is carried out.

5. An image forming apparatus comprising: an image carrier; an exposing unit configured to expose the image carrier to form latent images of respective colors for a single document onto the image carrier; a developing unit configured to develop each of the latent images of the respective colors to form toner images of respective colors; an intermediate transfer member configured to be in contact with the image carrier; and a secondary transferring unit configured to be contactable and retractable with and from the intermediate transfer member, wherein the image carrier transfers the toner images onto the intermediate transfer member, wherein the secondary transferring unit transfers the toner images on the intermediate transfer member onto a recording medium, wherein the secondary transfer member contacts with the intermediate transfer member before completing exposing operations of the exposing unit with respect to all of color toner images for the single document, and wherein the secondary transfer member retracts from the intermediate transfer member before starting exposing operations of the exposing unit with respect to a next document to be printed after the single document.

6. The image forming apparatus as claimed in claim 5, wherein the intermediate transfer member is made of an elastic belt and contacts with the image carrier under such condition that the image carrier is wrapped around for a predetermined range by the intermediate transfer member.

7. The image forming apparatus as claimed in claim 6, wherein the intermediate transfer member rotates by receiving driving force from a rotation of the image carrier.

8. The image forming apparatus as claimed in claim 5, further comprising an intermediate transfer member cleaning unit configured to remove residual toners remaining on the intermediate transfer member after the toner images being transferred onto the recording medium, and to be contactable and retractable with and from the intermediate transfer member, wherein the intermediate transfer member cleaning unit contacts with the intermediate transfer member at such timing that an exposing operation by the exposing unit is not carried out.

9. An image forming apparatus comprising: an image carrier configured to be formed thereon a toner image by being exposed at a predetermined exposing position; an intermediate transfer belt configured to temporarily hold thereon a toner images of a respective colors on a circumferential portion of the intermediate transfer belt; and a secondary transferring unit configured to be contactable and retractable with and from the intermediate transfer belt, wherein the image carrier transfers the toner image onto the intermediate transfer belt, wherein the secondary transferring unit transfers the toner image on the intermediate transfer member onto a recording medium, wherein a belt length of the intermediate transfer belt is determined by a sum of a maximum image length of a toner image held by the circumferential portion thereof, and an interimage length shorter than the maximum image length, and the secondary transferring unit contacts with the intermediate transfer belt over a process distance which is shorter than such a distance separated from the exposing position by the interimage length.

10. The image forming apparatus as claimed in claim 9, wherein the secondary transferring unit contacts with the intermediate transfer belt at such timing after the toner image having the maximum image length has passed a contacting position, when an interimage is being passed at the contacting position, and while no exposing process has been processed at the exposing position.

11. A control method for an image forming apparatus comprising: an image carrier; an exposing unit configured to expose the image carrier for respective colors of a specific document; an intermediate transfer member configured to be transferred thereon a toner images of the respective colors from the image carrier; a secondary transferring unit configured to transfer the toner images from the intermediate transfer member onto a recording medium, the control method comprising:

contacting the secondary transferring unit with the intermediate transfer member at such timing between an exposing operation for a specific color and an exposing operation for another color subsequent to the specific color contained in the specific document; and retracting the secondary transferring unit from the intermediate transfer member at such timing after transferring the toner images onto the recording medium and before starting an exposing operation for a next document to be printed after the specific document.

12. The control method of an image forming apparatus as claimed in claim 11 further comprising:

contacting an intermediate transfer member cleaning unit of the image forming apparatus that removes residual toners remaining on the intermediate transfer member after an exposing operation with respect to a last color of the specific document has been accomplished; and retracting the intermediate transfer member cleaning unit from the intermediate transfer member after an exposing operation with respect to a first color of the next document has been completed.

* * * * *